US010933547B2

(12) United States Patent
Kopelas et al.

(10) Patent No.: US 10,933,547 B2
(45) Date of Patent: Mar. 2, 2021

(54) SHAVING HANDLE SYSTEM FOR HOLDING A CARTRIDGE PIVOTABLE ABOUT TWO AXES

(71) Applicant: BIC-VIOLEX SA, Attiki (GR)

(72) Inventors: Panagiotis Kopelas, Dafni-Athens (GR); Dimitrios Efthimiadis, Nea Kypseli (GR)

(73) Assignee: BIC-VIOLEX SA, Attiki (GR)

( * ) Notice: Subject to any disclaimer, the term of this patent is extended or adjusted under 35 U.S.C. 154(b) by 0 days.

(21) Appl. No.: 16/478,353

(22) PCT Filed: Jan. 10, 2018

(86) PCT No.: PCT/EP2018/050596
§ 371 (c)(1),
(2) Date: Jul. 16, 2019

(87) PCT Pub. No.: WO2018/134105
PCT Pub. Date: Jul. 26, 2018

(65) Prior Publication Data

US 2019/0366570 A1 Dec. 5, 2019

(30) Foreign Application Priority Data

Jan. 17, 2017 (EP) ..... 17151794

(51) Int. Cl.
*B26B 21/22* (2006.01)
*B26B 21/24* (2006.01)
(Continued)

(52) U.S. Cl.
CPC ..... *B26B 21/225* (2013.01); *B26B 21/24* (2013.01); *B26B 21/4075* (2013.01);
(Continued)

(58) Field of Classification Search
CPC ..... B26B 21/225; B26B 21/24; B26B 21/521; B26B 21/4081; B26B 21/4075; B26B 21/528
See application file for complete search history.

(56) References Cited

U.S. PATENT DOCUMENTS 2,119,792 A 6/1938 Parkin
3,935,639 A 2/1976 Terry et al.
(Continued)

FOREIGN PATENT DOCUMENTS

DE 102013213881 1/2015
EP 1245351 10/2002
(Continued)

OTHER PUBLICATIONS

International Search Report dated Apr. 12, 2018 in corresponding PCT International Patent Application No. PCT/EP2018/050596, 2 pages.
(Continued)

*Primary Examiner* — Hwei-Siu C Payer
(74) *Attorney, Agent, or Firm* — Ohlandt, Greeley, Ruggiero & Perle, L.L.P.

(57) ABSTRACT

A shaving handle system for holding a cartridge including a handle extending longitudinally along a longitudinal handle direction (L) between a distal end and a proximal end, and a connector adapted to rotate around a rocking axis (Z) with respect to the handle. The connector includes two lateral tongues extending forwardly from the proximal end of the handle, and the handle includes a deflecting means for flexing either one of the lateral tongues. The lateral tongues abut the deflecting means, such that when the connector is rotated in a first direction around the rocking axis (Z) with respect to the handle, one of the two lateral tongues is flexed by the deflecting means, and such that when the connector is rotated in a second direction around the rocking axis (Z)
(Continued)

with respect to the handle, the other of the two lateral tongues is flexed by the deflecting means.

19 Claims, 11 Drawing Sheets

(51) Int. Cl.
*B26B 21/40* (2006.01)
*B26B 21/52* (2006.01)

(52) U.S. Cl.
CPC ..... *B26B 21/4081* (2013.01); *B26B 21/521* (2013.01); *B26B 21/528* (2013.01)

(56) References Cited

U.S. PATENT DOCUMENTS

| | | | | |
|---|---|---|---|---|
| 3,950,848 | A | 4/1976 | Goldstein | |
| 3,950,849 | A | 4/1976 | Perry | |
| 3,964,160 | A | 6/1976 | Gordon | |
| 4,152,828 | A | 5/1979 | Lund | |
| 4,403,414 | A * | 9/1983 | Kiraly | B26B 21/225 30/531 |
| 4,475,286 | A | 10/1984 | Saito | |
| 4,879,811 | A | 11/1989 | Cooney | |
| 5,029,391 | A | 7/1991 | Althaus et al. | |
| 5,038,472 | A | 8/1991 | Iderosa | |
| 5,050,301 | A | 9/1991 | Apprille, Jr. | |
| 5,953,824 | A | 9/1999 | Ferraro et al. | |
| 6,115,924 | A | 9/2000 | Oldroyd | |
| 6,381,857 | B1 | 5/2002 | Oldroyd | |
| 6,615,498 | B1 | 9/2003 | King et al. | |
| 7,137,205 | B2 | 11/2006 | Royle | |
| 7,200,942 | B2 * | 4/2007 | Richard | B26B 21/225 30/526 |
| 7,461,456 | B2 | 12/2008 | Tsushio et al. | |
| 7,461,458 | B2 * | 12/2008 | Peyser | B26B 21/225 30/532 |
| 7,526,869 | B2 * | 5/2009 | Blatter | B26B 21/225 30/532 |
| 8,151,472 | B2 | 4/2012 | Dimitris et al. | |
| 8,732,965 | B2 * | 5/2014 | Efthimiadis | B26B 21/521 30/526 |
| 8,745,882 | B2 | 6/2014 | Murgida et al. | |
| 8,745,883 | B2 * | 6/2014 | Murgida | B26B 21/521 30/527 |
| 8,898,909 | B2 | 12/2014 | Schmitt | |
| 8,978,258 | B2 | 3/2015 | Patel et al. | |
| 9,469,038 | B2 | 10/2016 | Iaccarino et al. | |
| 9,522,472 | B2 | 12/2016 | Leicht et al. | |
| 9,707,688 | B2 | 7/2017 | Giannopoulos et al. | |
| 9,849,599 | B2 | 12/2017 | Gers-Barlag et al. | |
| 10,538,007 | B2 | 1/2020 | Zucker | |
| 2011/0247217 | A1 | 10/2011 | Johnson et al. | |
| 2012/0073149 | A1 | 3/2012 | Murgida et al. | |
| 2012/0073150 | A1 | 3/2012 | Murgida et al. | |
| 2012/0255185 | A1 | 10/2012 | Patel et al. | |
| 2013/0081290 | A1 | 4/2013 | Murgida et al. | |
| 2015/0217466 | A1 | 8/2015 | Leicht et al. | |
| 2018/0021967 | A1 | 1/2018 | Murgida et al. | |
| 2019/0337174 | A1 * | 11/2019 | Kopelas | B26B 21/521 |
| 2019/0366570 | A1 * | 12/2019 | Kopelas | B26B 21/4075 |
| 2020/0039098 | A1 * | 2/2020 | Kopelas | B26B 21/225 |

FOREIGN PATENT DOCUMENTS

| | | |
|---|---|---|
| EP | 2508309 | 10/2012 |
| EP | 2902156 | 8/2015 |
| GB | 2096519 | 10/1982 |
| GB | 2116470 | 9/1983 |
| GB | 2463035 | 3/2010 |
| JP | 4-22388 | 1/1992 |
| WO | 93/20983 | 10/1993 |

OTHER PUBLICATIONS

Written Opinion dated Apr. 12, 2018 in corresponding PCT International Patent Application No. PCT/EP2018/050596, 4 pages.
International Search Report dated Apr. 20, 2018 in related PCT International Patent Application No. PCT/EP2018/050594, 2 pages.
Written Opinion dated Apr. 20, 2018 in related PCT International Patent Application No. PCT/EP2018/050594, 5 pages.
International Search Report dated Apr. 12, 2018 in related PCT International Patent Application No. PCT/EP2018/050595, 3 pages.
Written Opinion dated Apr. 12, 2018 in related PCT International Patent Application No. PCT/EP2018/050595, 5 pages.
Non-Final Office Action dated Oct. 16, 2020 in related U.S. Appl. No. 16/478,522, 23 pages.
Non-Final Office Action dated Oct. 14, 2020 in related U.S. Appl. No. 16/478,527, 22 pages.

* cited by examiner

SHAVING HANDLE SYSTEM FOR HOLDING A CARTRIDGE PIVOTABLE ABOUT TWO AXES

CROSS REFERENCE TO RELATED APPLICATION

This application is the US National Stage Entry Application of International Application PCT/EP2018/050596, filed Jan. 10, 2018, now published as WO/2018/134105 which claims priority to European Application EP17151794.9, filed on Jan. 17, 2017, the entire contents of which is incorporated herein by reference.

FIELD

The present disclosure relates to wet shavers comprising a cartridge pivotable about two pivot axes, and especially to shavers including a shaving handle system comprising connectors adapted to enable pivoting of the cartridge around the two axes.

BACKGROUND

There are well known safety razors where the cartridge is mounted on the handle with freedom to move about a rocking axis, which is transverse to the cutting edge of the cartridge or for movement about an axis parallel with the cutting edge of the cartridge.

Oftentimes the handle may include a yoke member and a spring adapted for biasing the yoke member to a central position, and also deforming resiliently to permit rocking of the cartridge about the rocking axis.

SUMMARY

In order to achieve the above-mentioned technical advantages, the shaver according to the present disclosure comprises a shaving handle system for holding a cartridge comprising a handle extending longitudinally along a longitudinal handle direction between a proximal end and a distal end. The shaving handle system comprises a connector adapted to rotate around a rocking axis with respect to the handle, the connector comprising two lateral tongues extending forwardly from the proximal end of the handle. The handle comprises a deflecting means for flexing either one of the lateral tongues. The lateral tongues are abutting the deflecting means, such that when the connector is rotated in a first direction around the rocking axis with respect to the handle, one of the two lateral tongues is flexed by the deflecting means, and such that when the connector is rotated in a second direction around the rocking axis with respect to the handle, the other of the two lateral tongues is flexed by the deflecting means.

Many modern wet shavers are adapted for the cartridge to pivot around an axis parallel with blades. Some shavers provide one additional degree of movement by enabling the cartridge to rotate about a second axis. The mechanisms adapted to allow for such rotation around the second axis are rather complex and could be complicated to manufacture. As such, the present disclosure introduces a technical solution of how to interconnect a cartridge with a handle in a simple manner via a connector, thus allowing the shaver to be manufactured in large number in a short time with minimum costs. The shaver with the simple interconnecting shaving handle system of the present disclosure also aims to save more material in the process.

The simple interconnecting shaving handle system includes two lateral tongues provided on the connector that interconnects the handle with the cartridge. As the connector rotates about the rocking axis, the lateral tongues generate biasing force, which urges the connector back into its non-rotated position. The two lateral tongues are independent of each other and provide reliable movement to and from either one of the two directions to which it rotates. Single elastic tongues are used in the prior art to create biasing force to a cartridge pivoting about an axis parallel with cutting edges of the blades. The present disclosure introduces an additional pair of tongues, which may complement the use of such single elastic tongues. Specifically, the two lateral tongues are designed to provide biasing force in case of rotational movements around different axis than those parallel with the cutting edges (for example about an axis transverse to the cutting edges).

Embodiments of the present disclosure may include one or more of the following additional features:

the shaving handle system further comprises an elongated support and a pair of hooks, the elongated support and the pair of hooks extending from the proximal end of the handle for movably attaching the connector to the handle; the way how the connector and the handle are connected to each other improves the quality of the sliding movement of the connector with respect to the handle, since the less parts are present to obstruct such movement, the more fluent the movement appears to be; also, with the more complex structural alternatives known from the field of shavers, there exists a high degree of probability that hair debris and water may gather in some parts of the product; this is largely avoided by the constructional simplicity of the current inventive concept in that it allows the shaver to be properly rinsed; an alternative is thus provided to the more complex and more expensive designs known from the art without sacrificing the quality of shaving experience; to the contrary, new alternative solutions to even increase the quality of shaving are proposed;

the handle has an upper face and a lower face, the upper face being opposite to the lower face, wherein the elongated support extends from the lower face and the hooks extend from the upper face; the elongated support and the pair of hooks are adapted to reliably hold the connector in position and allowing it to rotate in an unobstructed fashion; the position of the elongated support at the lower face of the handle and the pair of hooks at the upper face of the handle ensures steady position of the connector with respect to the handle on one hand, and smooth rotation of the connector with respect to the handle on the other hand; one purpose of the present concept is to ensure smooth unobstructed rotational movement of the cartridge about the axes both from and into a neutral position; both these goals are achieved by simple structural features;

the connector comprises a pair of elongated arms, each arm having an end, wherein a pivot axis is parallel to the line connecting the end of the arms, whereas the rocking axis is transverse to the line connecting the ends of the arms, the connector being movably attached along the rocking axis to the handle; with this configuration of the two axes around which the cartridge moves, the above attachment of the connector to the handle is especially effective; the movement of the cartridge about the pivot axis can be achieved by use of shell bearings, while the movement of the cartridge about the rocking axis can be achieved by swivelling connector; thereby, the two rotational movements are independent of each other and thus less complex; reducing complexity of the structure in this way leads to smoother movement;

the connector is movable along the rocking axis between a first end position and a second end position;

each of the arms comprise a bearing structure;

the pivot axis and the rocking axis intersect each other; such mutual orientation of axes offers more comfortable shaving compared to other orientations;

the proximal end of the handle comprises an oval depression, and the connector is provided with an arcuate face matching side to side with the shape of the oval depression, the arcuate face of the connector being adapted to rock along the oval depression of the handle around the rocking axis transverse to the line connecting the ends of the arms; the oval depression in the handle and the arcuate face of the connector are adapted to maintain constant contact with each other, thus ensuring proper alignment of the individual components during the process of shaving;

the arms extend substantially in a common plane, and the connector comprises a flexible central tongue extending substantially in the same plane as the two arms;

the central tongue and each of the lateral tongues are separated and independent of each other;

the elongated support extends forwardly from the middle of the width of the proximal end of the handle, the support comprising: an upwardly protruding block for fixing the connector to the handle, and the deflecting means in the form of a deflector forming the end of the elongated support and being curved in the upward direction;

the shaving handle system comprises two elongated supports extending forwardly from each side of the proximal end of the handle, and the elongated supports each comprise: an upwardly protruding step extending along the entire width of the elongated support and adapted to fix the connector to the handle, and the deflecting means in the form of a pin located at the end of the elongated support and protruding in the upward direction;

the connector further comprises reinforcing ribs extending along the length of the arms and towards the center of the connector, the reinforcing ribs being adapted to engage with the steps of the elongated supports, thereby fixing the connector to the handle;

the shaving handle system comprises a stud protruding upwardly from the connector, wherein the connector is adapted to rock from a rest position to the first end position or the second end position, wherein in the first end position the rocking of the connector is stopped by the stud coming into contact with a first of the pair of hooks, and wherein in the second end position the rocking of the connector is stopped by the stud coming into contact with a second of the pair of hooks;

the width of the elongated support taken along the line connecting the ends of the arms is not greater than one third of the width of the proximal end of the handle taken along the line connecting the ends of the arms; this feature aims to provide an increased effectivity and reliability of the attachment of the connector to the handle, while leaving as much space as possible for an unobstructed movement of the connector with respect to the handle; using less material implies less cost in the production, and also less potential friction between the connector and the handle, which could otherwise disrupt the rotational movement; reduced friction may be achieved with various materials, such as plastic materials.

The shaving handle system is adapted for use in a shaving razor having a cartridge comprising at least one blade having a blade edge extending along a blade edge axis, where according to some embodiments, the shaving razor may comprise one or more of the following features:

the connector of the shaving handle system comprises a pair of elongated arms, each arm having an end, wherein a pivot axis is parallel to the line connecting the end of the arms, whereas a rocking axis is transverse to the line connecting the ends of the arms, the connector being movably attached along the rocking axis to the handle;

the blade edge axis is parallel to the pivot axis;

the cartridge and the connector are attached to each other such that the cartridge and the connector rotate simultaneously around the rocking axis; and the cartridge is pivotally attached to the connector along the pivot axis.

DETAILED DESCRIPTION

The following description of the main embodiments of the present disclosure is made with reference to the accompanying drawings, where the same reference numbers denote identical or similar elements.

Figure 1:
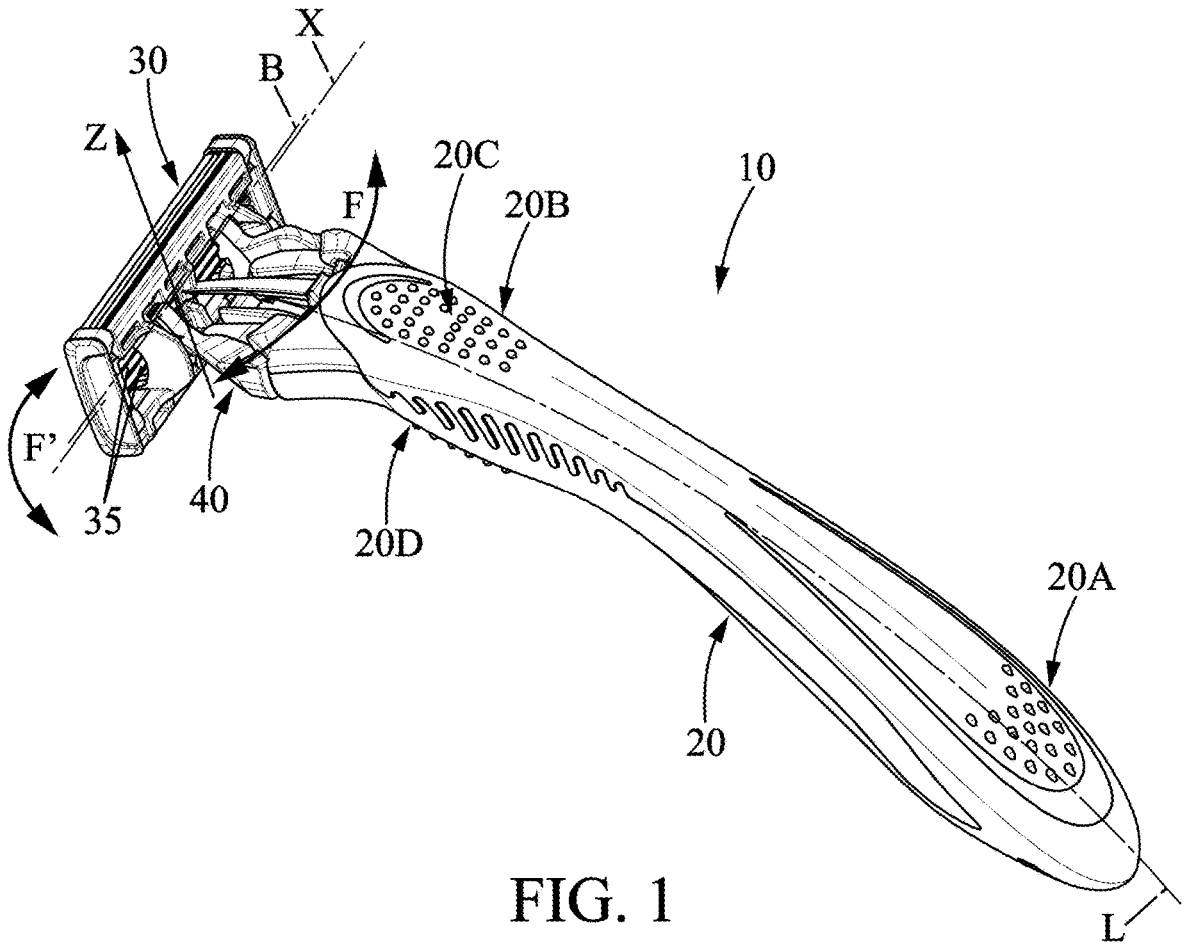
FIG. 1 is an overall view of the shaver according to the present disclosure.

FIG. 1 shows a shaver 10 according to the present disclosure. The shaver 10 comprises a handle 20 having an elongated shape with a distal end 20A and a proximal end 20B. The handle 20 thus extends longitudinally along a longitudinal handle direction L between the distal end 20A and the proximal end 20B. The handle 20 further includes a lower face 20D and an upper face 20C. The upper face 20C is opposite the lower face 20D. The handle 20 can have any suitable shape known in the art and can be made from any material, for example metal or plastic. Additional materials may be used on the handle 20 in order to improve the grip of the handle 20 during its use. The handle 20, especially the proximal end 20B of the handle 20, may have a width WH measured between its two sides, as depicted in FIGS.

Figure 6:
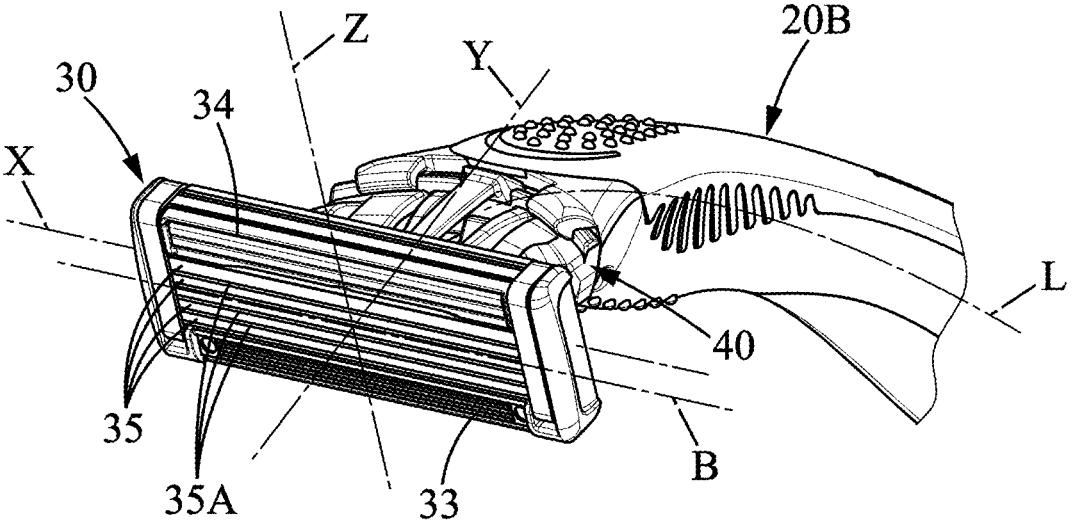
FIG. 6 is a partial perspective view of a possible position of the two pivot axes of the shaver with respect to the blade edge axis (B).

4A-4B. The width of the handle 20 at its distal end 20A may be different and may also vary along the length of the handle 20. The shaver 10 further comprises a cartridge 30 having an elongated shape and including one or more elongated blades 35 extending along the longitudinal direction of the cartridge 30. Each one of the one or more blades 35 has a blade edge 35A extending along a blade edge axis B, as illustrated in FIG. 6. The longitudinal direction of the cartridge 30 could be identified with the blade edge axis B. The longitudinal direction of the cartridge 30 and the blade edge axis B are generally parallel to each other.

Figure 9:
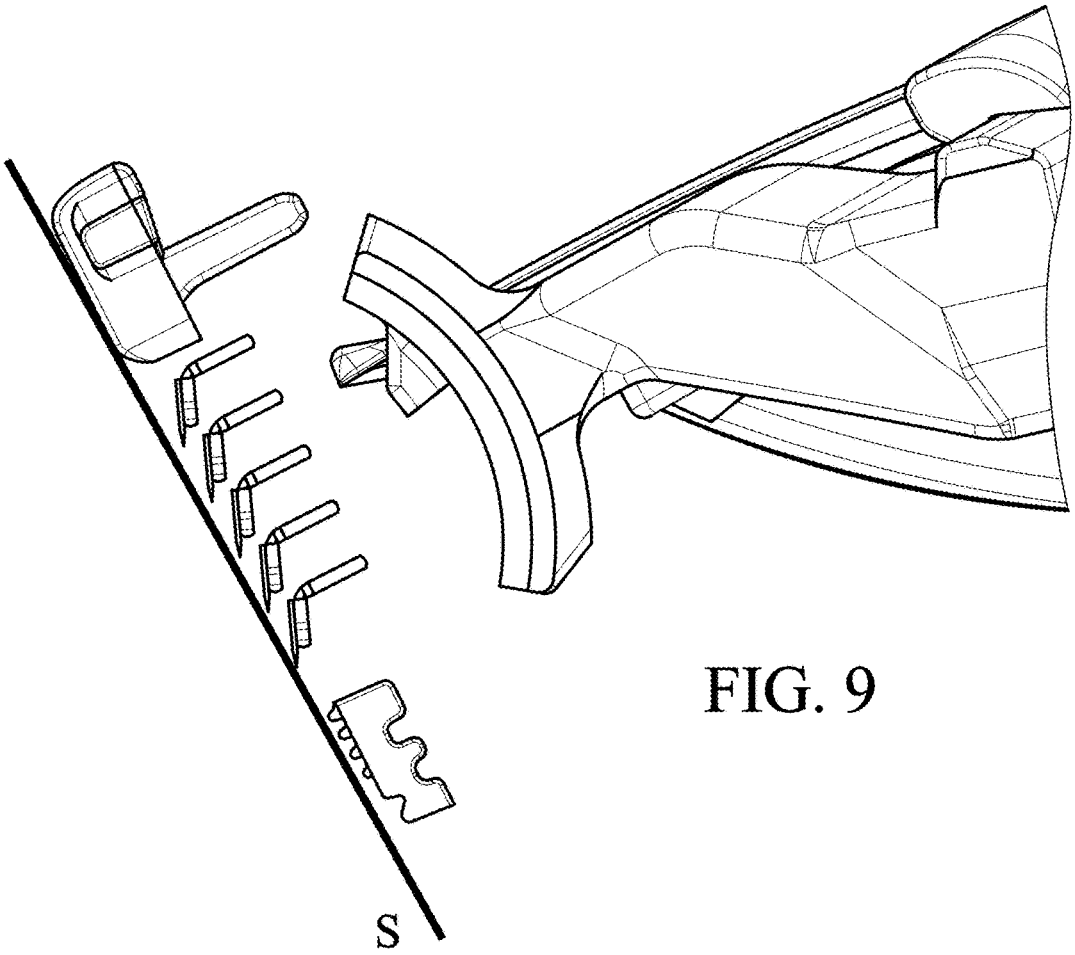
FIG. 9 is illustration defining the term shaving plane S as used in the present disclosure.

As can be also seen in FIG. 6, the cartridge 30 may include a guard 33 and a cap 34 forming skin engaging surfaces. The top surface of the guard 33 and the top surface of the cap 34 are used as general reference for defining a shaving plane. The shaving plane is thus defined entirely by the contours of the front side of the cartridge 30 where the blade edges 35A are located. More explicitly, the shaving plane could be defined as illustrated on FIG. 9, i.e. the shaving plane is a plane tangent to the surface of the guard 33 and the surface of the cap 34. The shaving plane thus does not intersect either the guard 33 or the cap 34 but touches both the guard 33 and the cap 34 at exactly one point of their surfaces. The one or more blades 35 may extend above, in, or below the shaving plane, or may have any other suitable configuration, such as increasing or decreasing exposure. The exposure is equal to the distance measured from the shaving plane to the cutting edge 35A of the blade 35. The shaver 10 further comprises a connector 40 explained in more detail with reference to FIG. 2.

Figure 2:
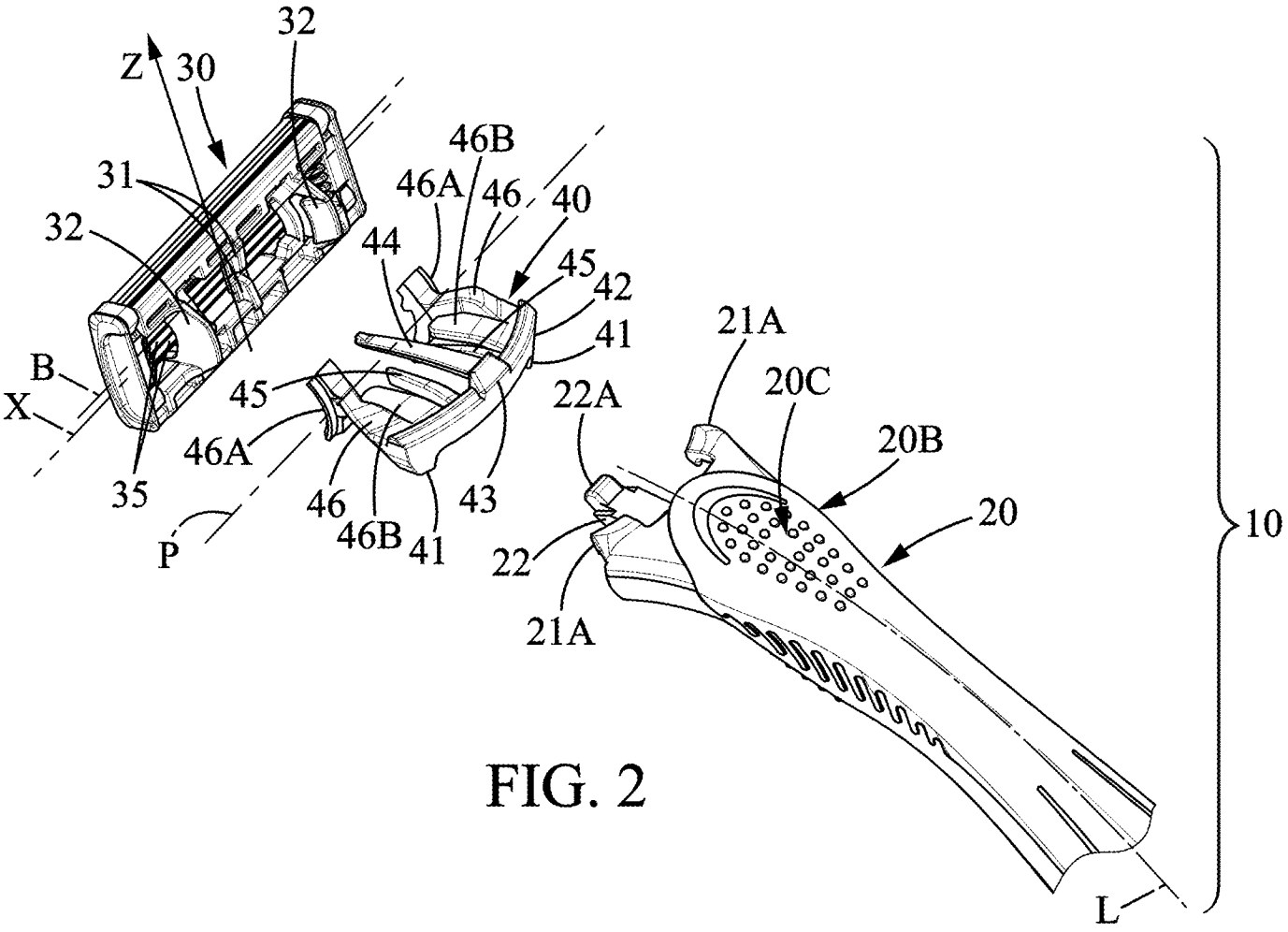
FIG. 2 is a partial exploded view of the components comprised in the shaver of FIG. 1.

As visible in FIG. 2, the cartridge 30 includes a pair of looped hooks 32 adapted to be engaged with shell bearings 46A to enable pivotal movement of the cartridge 30. The looped hooks 32 and the shell bearings 46A can alternatively be replaced by other suitable bearing structures, such as pins and holes. The cartridge 30 is adapted to rotate about a pivot axis X, which can be parallel with one or more blades 35, and especially with the blade edge axis/axes B. The direction of rotation of the cartridge 30 around the pivot axis X is labeled by the double-arrow F' in FIG. 1. Depending on the embodiment, the cartridge 30 can be adapted to rotate in one or both directions illustrated by the arrow F'. As best seen in FIG. 2, the shaver 10 comprises the cartridge 30, the handle 20 and a connector 40. The connector 40 is part of the handle and is positioned between the cartridge 30 and the proximal end of the handle 20B. The cartridge 30, the handle 20 and the connector 40 form three separate elements of the shaver 10, which are assembled together. The cartridge 30 is unreleasably attached to the connector 40 and the connector 40 is unreleasably attached to the handle 20. However, configurations where the cartridge 30 is replaceably/releasably attached to the connector 40 and/or where the connector 40 is replaceably/releasably connected to the handle 20 are also possible. Generally, as it will be explained further in the description, the cartridge 30 is movable with respect to the connector 40, and the connector 40 is movable with respect to the handle 20. The handle 20 and the connector 40 are commonly referred to as a shaving handle system. This shaving handle system, as described herein, is adapted for holding a cartridge 30. The shaving handle system is further adapted to enable the cartridge 30 to move about two different axes, i.e. to perform pivotal and/or rotational movement with regard to the handle 20.

Referring further to FIG. 2, at the proximal end 20B, the handle 20 comprises an elongated support 22, 24 and a pair of hooks 21A. Two examples of the elongated support 22, 24 are disclosed, a beam support 22 and a platform support 24. FIGS. 2, 3, 4A-4B show the beam support 22, whereas FIGS. 5A-5B show the platform support 24. The elongated support 22, 24 is positioned at the lower face 20D of the handle 20 and extends therefrom, while the pair of hooks 21A is disposed at the upper face 20C of the proximal end 20B of the handle 20 and extends therefrom. The hooks 21A are provided on each side of the proximal end 20B of the handle 20. In some alternative embodiments, more than two hooks 21A could be provided along the upper edge of the proximal end 20B of the handle 20, for example three or four.

The connector 40 is adapted for attaching the cartridge 30 to the proximal end 20B of the handle 20. For this purpose, the connector 40 is formed by a pair of arms 46. The arms 46 extend substantially between the handle 20 and the cartridge 30. Each arm 46 has an end 46A, which may be constructed as a shell bearing, i.e. as holder having a rounded surface. The ends 46A of the arms 46 can be seen as defining an imaginary line P. The line P spans between the ends 46A of the arms 46 and creates an imaginary connection between the two ends 46A of the arms 46. According to one embodiment, the pivot axis X is defined as an axis, which is parallel to the line P connecting the ends 46A of the arms 46. The handle system may further comprise a rocking axis Z, which is transverse to the line P connecting the ends 46A of the arms 46, such that the connector 40 is movably attached along the rocking axis Z (best visible in FIG. 1, 2, or 6) to the handle 20. The direction of rotation of the connector 40 about the rocking axis Z is labeled with the double-arrow F shown of FIG. 1. The connector 40 is adapted to be rotated in each of the two directions illustrated by the arrow F.

The connector 40 extends in a plane PY, defined by the line P and a connector axis Y. Line P connects the ends 46A of the arms 46. With the connector 40 in neutral non-rotated position, the connector axis Y is identical with the longitudinal handle direction L. When the connector 40 is rotated around the rocking axis Z in the direction of the arrow F, the connector axis Y forms an angle R with the longitudinal handle direction L, as, illustrated in FIGS. 4B and 5B. The intersection of the longitudinal handle direction L and the connector axis Y is the point, where the rocking axis Z is located (see FIGS. 4B, 5B). The pair of arms 46 may extend in a common plane PY as illustrated in FIGS. 4A, 4B, 5A and 5B.

In some embodiments, the cartridge 30 is adapted to perform a movement from a non-pivoted position up to an extreme pivoted position. The extreme pivoted position of the cartridge 30 may correspond to rotation about a pivot angle A up to 40° (and could equal for example to 20°, or 30°). The pivot angle A is a difference angle between the non-pivoted and the extreme pivoted position of the cartridge 30, corresponding to the rotation about the pivot axis X.

The above definition of the pivot axis X includes various possible positions of the pivot axis X. The pivot axis can be located to intersect the inside of the cartridge 30, or the pivot axis may lie outside the cartridge body in front of the blade edges 35A, such that it lies substantially within the surface of the skin during shaving. The pivot axis X may be parallel with the shaving plane. The pivot axis X may also lie close to the shaving plane or may be part of the shaving plane. The pivot axis X may be identical with a blade edge axis B. The rocking axis Z is perpendicular to the pivot axis X.

Reference will now be made with the cartridge 30 in the neutral non-pivoted position. In this position, the rocking axis Z may be parallel with the shaving plane S, or may be included in the shaving plane S. Alternatively, the rocking axis Z may form an angle with the shaving plane S. When the cartridge is not pivoted about the pivot axis X, the rocking axis Z may intersect two or more blade edge axes B, where two or more blades 35 are provided in the cartridge 30. The pivot axis X and the rocking axis Z may intersect each other. This point of intersection of the pivot axis X and the rocking axis Z can lie in the shaving plane S. In some embodiments, the point of intersection of the pivot axis X and the rocking axis Z may be located on a blade edge axis B. In other embodiments, the intersection of the pivot axis X and the rocking axis Z may lie above or below the shaving plane S (the shaving plane being defined on FIG. 9). In some embodiments, the rocking axis Z can penetrate the body of the cartridge 30, or it can lie outside the cartridge body in front of the blade edges 35A. The rocking axis Z may intersect two or more blade edge axes B, if two or more blades 35 are provided in the cartridge 30. The rocking axis Z may alternatively lie in the plane formed by the guard 33 and the cap 34. The rocking axis Z is perpendicular to the common plane PY in which the arms 46 extend.

The rocking axis Z, however, may also form an angle with the plane PY taking into account slight allowable variations in the position of the rocking axis Z. For example, the right angle between the rocking axis Z and the plane PY could be varied by about 2°, 4°, 6°, or 8°, as it is applied on true position tolerancing for axis placement in the GD&T standard As shown in FIG. 10A-10C, there are three possible configurations of the rocking axis Z with respect to the shaving plane S.

Figure 10A:
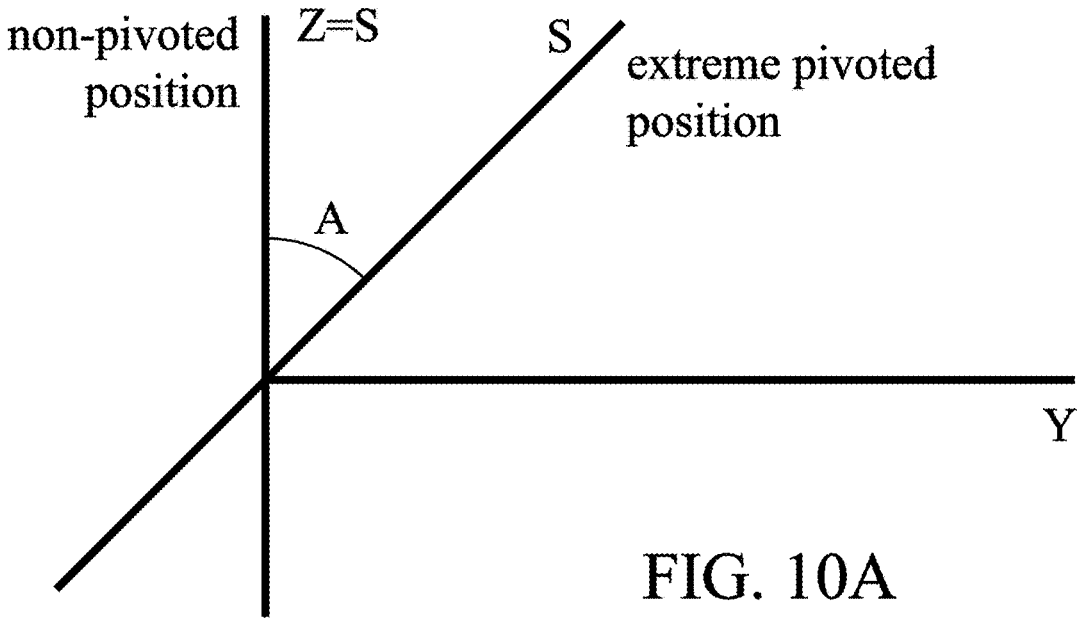
FIGS. 10A-10C show the relative position of the rocking axis and the shaving plane in the non-pivoted position of the cartridge and the extreme position of the cartridge according to various embodiments.

FIG. 10A shows an arrangement, where the rocking axis Z lies within the shaving plane S, when the cartridge 30 is in the non-pivoted position. The cartridge 30 may rotate about the pivot axis X along the pivot angle A, which could be 20°, 30° or 40°. In this embodiment, the rocking axis Z and the shaving plane S of the cartridge 30 in the extreme pivoted position form an angle equal to the pivot angle A (maximum angle around which the cartridge 30 can be pivoted). Also, in this embodiment, since the rocking axis Z is perpendicular to the plane PY, the shaving plane S is perpendicular to the plane PY in the non-pivoted position. Then, if the pivot angle A is equal to 40°, the shaving plane S forms and angle of 50° with the plane PY, when the cartridge 30° is in the extreme pivoted position.

Figure 10B:
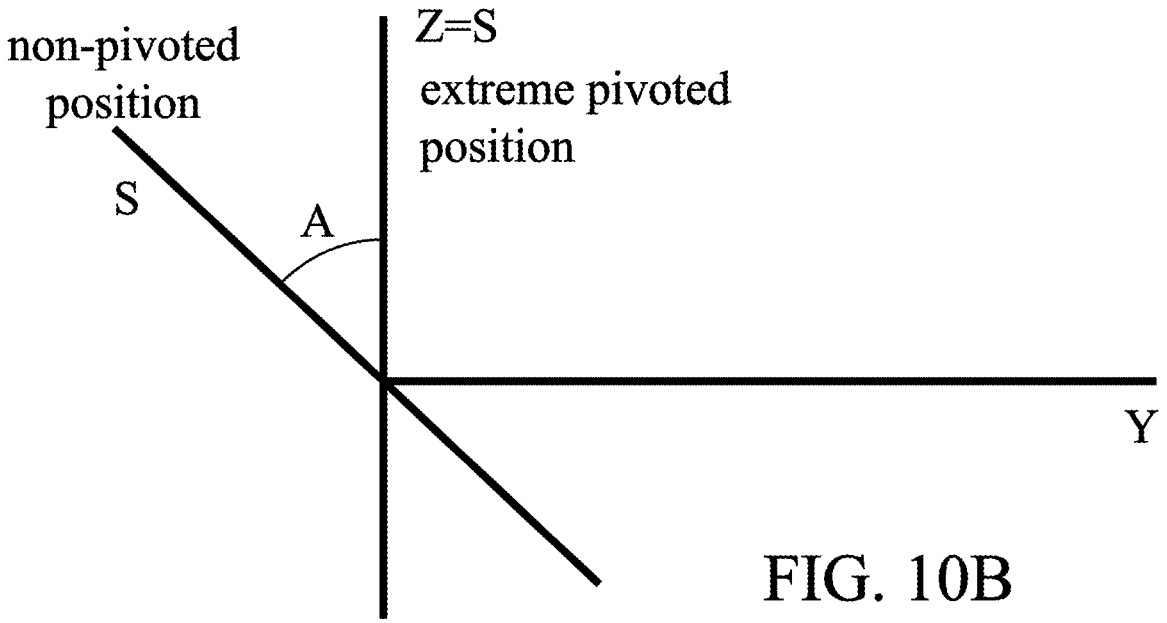
Figure 10C:
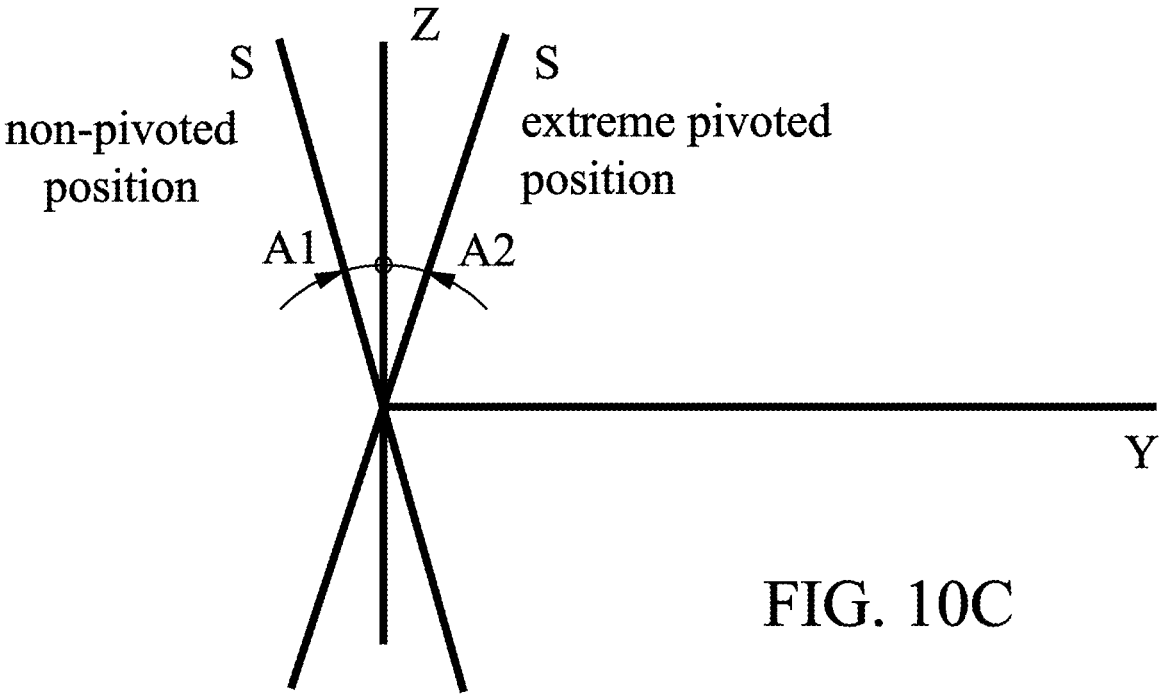

FIG. 10B shows an alternative arrangement between the rocking axis Z and the shaving plane S. Here, the rocking axis Z lies within the shaving plane S, when the cartridge 30 is in the extreme pivoted position. Thus, in the extreme pivoted position of the cartridge 30, the shaving plane S and the plane PY form the right angle. If the pivot angle A is equal to 40°, then in the non-pivoted position of the cartridge 30, the shaving plane S forms an angle of 130° with the plane PY.

Both embodiments of FIGS. 10A and 10B could be used with various shapes of the handle 20.

FIG. 10C shows an embodiment, where the rocking axis Z lies in between the locations of the shaving plane S corresponding to the non-pivoted position and the extreme pivoted position of the cartridge 30. Between the shaving plane S in the non-pivoted position and the rocking axis Z, there is formed a first angle A1. Between the shaving plane S in the extreme rotated position and the rocking axis Z, there is formed a second angle A2. By definition, A1+A2=A. The rocking axis Z lies exactly in the middle of the angle between the non-pivoted position and the extreme pivoted position, i.e. A1=A2. The sum of the first angle A1 and the second angle A2 could be for example 40°. In one particular embodiment, the first angle A1 and the second angle A2 are thus both 20°. However, favorable results have also been achieved when testing such a configuration, where the second angle A2 lies anywhere between 0° and A/2°, for example the second angle A2 could be 5°, 10° or 15°.

The cartridge 30 further includes one or two cams 31, or cam surfaces, adapted to cooperate with a central elastic tongue 44. The central elastic tongue 44 generates biasing force acting on the cartridge 30, when the cartridge 30 is pivoted about the pivot axis X, thus forcing the cartridge 30 to return to a non-pivoted position. The non-pivoted position corresponds to such a position of the cartridge 30, where no shaving forces are applied thereto, and where the cartridge 30 is not pivoted with respect to the pivot axis X, such that the cartridge 30 is in a neutral state. The cartridge 30 in the non-pivoted position is illustrated, for example, in FIG. 6.

As can be seen in FIG. 2, the connector 40 further includes an arcuate face 42 interconnecting the two arms 46. The arcuate face 42 extends substantially along the width WH of the proximal end 20B of the handle 20 and is adapted to maintain contact therewith. The arcuate face 42 lies substantially in the same common plane PY as the two arms 46. Each arm 46 is disposed on one side of the connector 40 and extends from the side adjacent to the handle 20 forwardly towards the cartridge 30. The arms 46 may or may not be straight. For example, the arms 46 may be curving towards the middle of the connector 40. Alternatively, the arms 46 may be curving downwards or upwards in order to reflect the general shape of the handle 20. At the end 46A of each arm 46 is located a shell bearing for attaching the cartridge 30 to the connector 40 via the pair of looped hooks 32 located on the cartridge 30.

From the center part of the arcuate face 42 forwardly towards the cartridge 30 extends a central tongue 44. The central tongue 44 extends generally parallel with the two arms 46 and is located in the middle between the two arms 46. Adjacent to the central tongue 44, there extend two lateral tongues 45. The central tongue 44 lies in the same plane PY as the two arms 46. It may also lie above or below this plane PY, being substantially parallel to this plane PY. The lateral tongues 45 are located between the central tongue 44 and the corresponding arm 46. Each lateral tongue 45 extends forwardly from the arcuate face of the connector 40 toward the cartridge 30. The lateral tongues 45 thus extend generally in the same direction as the two arms 46 and the central tongue. The lateral tongues 45 can be shorter than the central tongue 44. The length of the lateral tongues 45 ranges between 50-90% of the length of the central tongue 44. The lateral tongues 45 may be located either in the same plane PY as the arms 46, or in a plane extending below the plane PY. Each lateral tongue 45 is made from elastic material such that flexing of the lateral tongue 45 is possible. The elastic material could be, for example, plastic.

The connector 40 may comprise reinforcing ribs 46B protruding from each arm 46 towards the center of the connector 40, where the elastic tongues 44, 45 are located. The reinforcing ribs 46B may extend along most of the length of the arms 46. According to some embodiments, the reinforcing ribs 46B span along 30-90% of the length of the arms 46. The reinforcing ribs 46B may have the same length as the lateral tongues 45. For example, the reinforcing ribs 46B may be half of the length of the arms 46. The connector 40 may also include a stud 43 protruding upwards from the central portion of the arcuate face 42. The sides of the connector 40 may be symmetrical with respect to a plane of symmetry passing through the central tongue 44. The plane of symmetry can be transverse to the plane PY.

Figure 3:
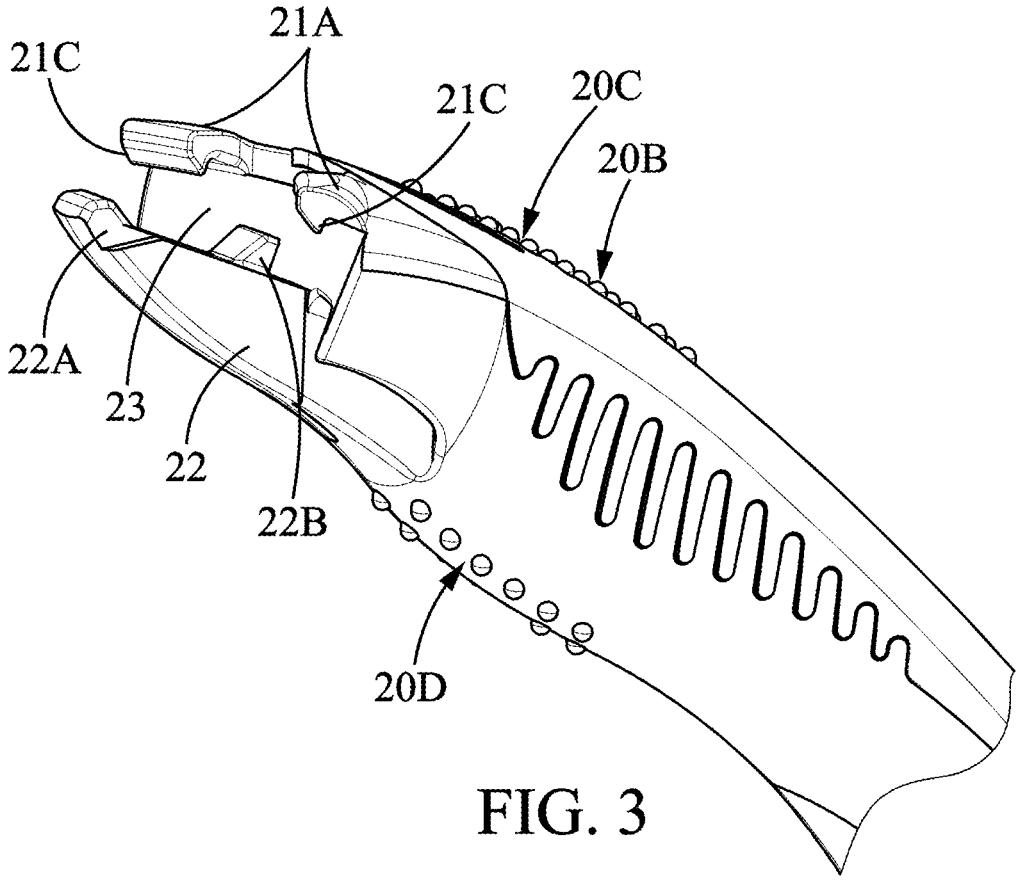
FIG. 3 shows a partial view of the proximal part of the handle of the shaver of FIG. 1.

Referring to FIG. 3, the proximal end 20B of the handle 20 further comprises an oval depression 23 extending across the width WH of the handle 20. The oval depression 23 has a round concave shape curving inwardly into the proximal end 20B of the handle 20. The oval depression 23 has a shape complementary to the shape of the arcuate face 42 of the connector 40, so that the oval depression 23 fits closely to the arcuate face 42. In other words, the arcuate face 42 matches side to side with the shape of the oval depression 23. This feature is best apparent from FIGS. 2, 4 and 5, and also from the cross-sections of FIGS. 7 and 8. The oval depression 23 and the arcuate face 42 are adapted to slide with respect to each other, thus creating a rotational movement of the connector 40 around a rocking axis Z best seen on FIG. 1, 2, or 6. The cartridge 30 and the connector 40 may be attached to each other such that they are rotated simultaneously around the rocking axis Z, as the shaving forces are applied to the cartridge 30. The connector 40 is adapted to rotate to one side into a first end position, or the other side to a second end position. Analogically, the cartridge 30 may also rotate between a first end position and a second end position.

Generally, the elongated support 22, 24 extends from a portion of the proximal end 20B of the handle 20 to support the connector 40 from below, while the pair of hooks 21A support the connector 40 from above. The elongated support 22, 24 extends from lower face 20D of the proximal end 20B of the handle 20. The elongated support 22 may have a beam shape, which can be seen on FIG. 2, 3, or 4A-4B. The elongated support 22 may be further provided with a block 22B. The block 22B fixes the connector 40 to the handle 20 and prevents any loose movements. More particularly, the block 22B prevents the arcuate face 42 of the connector 40 from sliding forward (i.e. away from the proximal end 20B of the handle 20) and thus allows the arcuate face 42 to maintain contact with the oval depression 23. According to one possible embodiment the beam support 22 further comprises a deflector 22A, which forms the tip of the elongated support 22 and curves upward. The hooks 21A each comprise a protrusion 21C extending downward from the hooks 21A. Similar to the function of the block 22B, the protrusions 21C are also adapted to secure the connector 40, and especially the arcuate face 42 of the connector 40, to the proximal end 20B of the handle 20.

In an alternative embodiment, the elongated support 24 may have a platform shape, such as that on FIGS. 5A-5B. The elongated support 24 can be provided in pair, each one protruding forwardly towards the cartridge 30 from one side of the proximal end 20B of the handle 20. Each of the elongated supports 24 can comprise a pin 25 pointing upward. The pin is located at the end of the elongated support 24. Depending on the length of the lateral tongues 45, the pin 25 may be located anywhere between the end and the middle of the length of the elongated support. The pin 25 can also be used in the embodiment where the singly elongated support 22 extends from the middle of the width WH of the proximal end 20B of the handle. There can also be a step 24B substantially in the middle of the length of each elongated support 24. The step 24B divides the platform in two parts, one part having its surface lying below the surface of the other part, both surfaces being substantially parallel. Each step 24B can be adapted to engage with the corresponding reinforcing rib 46B, so as to fix the connector 40 in place, allowing only for the swiveling movement of the connector 40 with respect to the handle 20. The steps 24B of each elongated support 24 engaging with the reinforcing ribs 46B serve similar function as the block 22B of the beam-like support 22 engaging with the arcuate face 42.

The above described appearances of the beam support 22 and the platform support 24 are only given examples and may be modified, or the features pertaining to one type of support may appear on the other type of elongated support and may be combined with other features. For example, the deflector 22A of the beam support 22 may be replaced with a pin 25 of the platform support 24, since they serve a similar function. The beam support 22 may be provided in pair and can extend from the sides of the handle 20, instead of extending from the central part. Similarly, single platform support 24 may extend from the central portion of the proximal end 20B. Similarly, the reinforcing ribs 46B cooperating with steps 24B, or the block 22B cooperating with the arcuate face 42 could appear on either type of the elongated support. In some embodiments, the number of elongated supports can be three (extending from the sides and from the center) or more.

The elongated support 22, 24 may have a width WB, WP. The width WB, WP of the elongated support 22, 24 is not greater than one third of the width WH of the proximal end 20B of the handle 20. The width WH of the proximal end 20B of the handle is taken along the line P connecting the ends of the arms 46. Since the line P may rotate together with the connector 40, the width WH is taken along the line P, when the connector is in non-rotated position. For example, the width WB, WP of the support 22, 24 could be one fourth of the width WH of the proximal end 20B. Similar arrangement is possible with regard to the width (not showed on the drawings) of the hooks 21A. The hooks 21A should be no wider than one third of the width WH of the proximal end 20B, for example can have the width about one fourth of the width WH of the proximal end 20B.

The present concept provides means for rotating the cartridge 30 around two pivot axes by using simple mechanical components and ensures quality of the movement by increasing its smoothness, thereby leading to a better shaving experience. The two different pivotal movements should be independent from each other. This also applies to biasing forces applied, when the cartridge 30 is being returned to the non-pivoted (referring to the pivoting about the pivot axis X) and/or non-rotated position (referring to the rotation about the rocking axis Z). In other words, these biasing forces should also be independent of each other.

The arcuate face 42 of the connector 40 is adapted to swivel along the oval depression of the handle 20, such that the connector 40 rotates with respect to the handle 20 around the rocking axis Z, as the shaving forces are applied to the cartridge 30. In general, the elongated support 22, 24 comprises deflecting means. The connector 40 comprises two lateral tongues 45 extending in a direction substantially perpendicular to both the pivot axis X and the rocking axis Z. The lateral tongues 45 abut the deflecting means, such that when the cartridge 30 is rotated in a first direction around the rocking axis Z, one of the two lateral tongues 45 is flexed by the deflecting means, and such that when the connector 40 is rotated in a second direction around the rocking axis Z, the other of the two lateral tongues 45 is flexed by the deflecting means. The flexion of each of the lateral tongues 45 generates biasing force returning the rotated connector 40 into the non-rotated position. Since the cartridge 30 and the connector 40 are attached to one another, the rotation of the connector 40 is in each case accompanied with the corresponding rotation of the cartridge 30. The central tongue 44 and each of the lateral tongues 45 are separated and independent of each other.

Figure 4A:
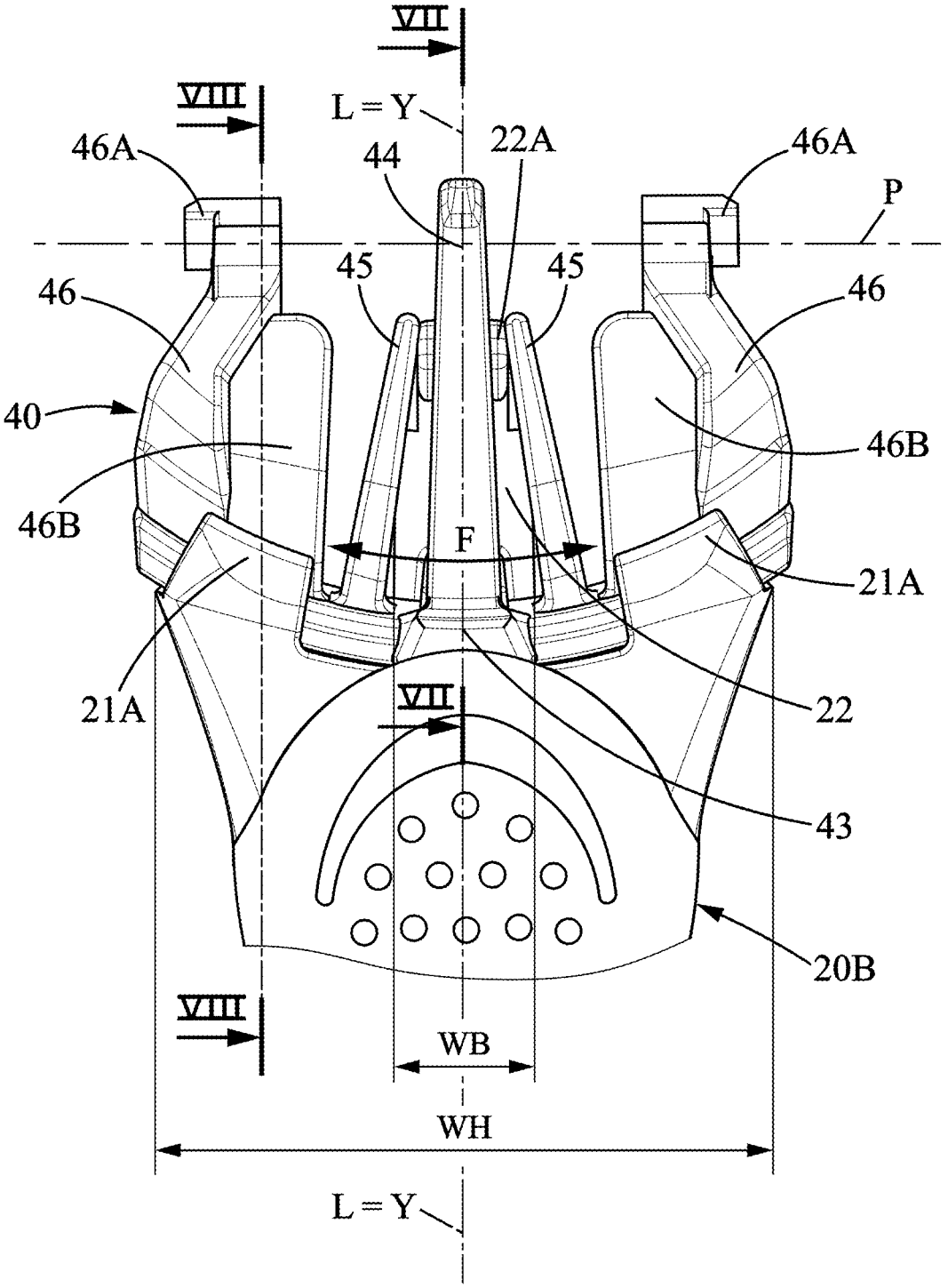
FIG. 4A shows a partial top view of the proximal part of the handle according to the first embodiment with the connector being in the neutral position.
Figure 4B:
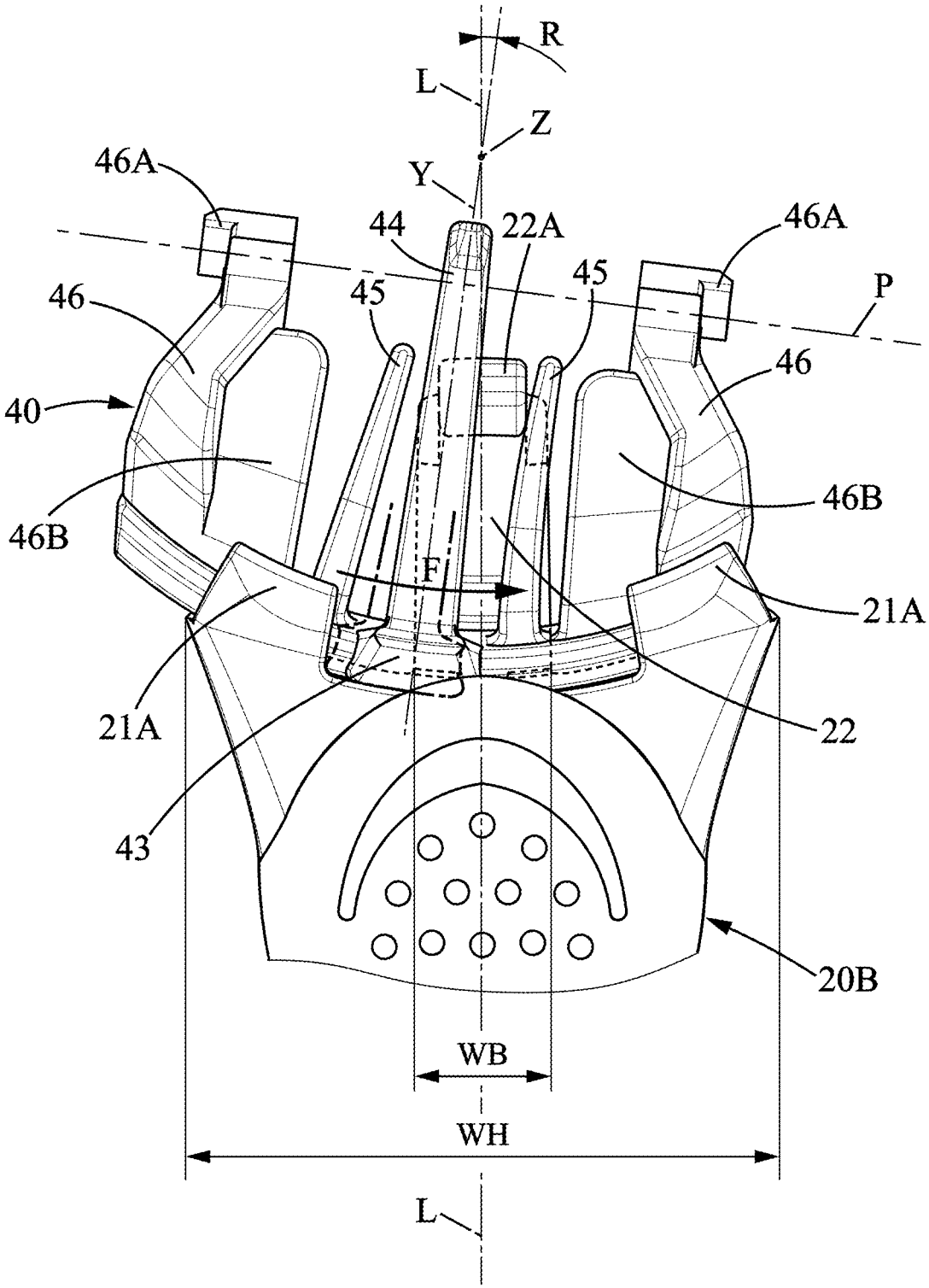
FIG. 4B shows a partial top view of the proximal part of the handle according to the first embodiment with the connector in an end rotated position.
Figure 5A:
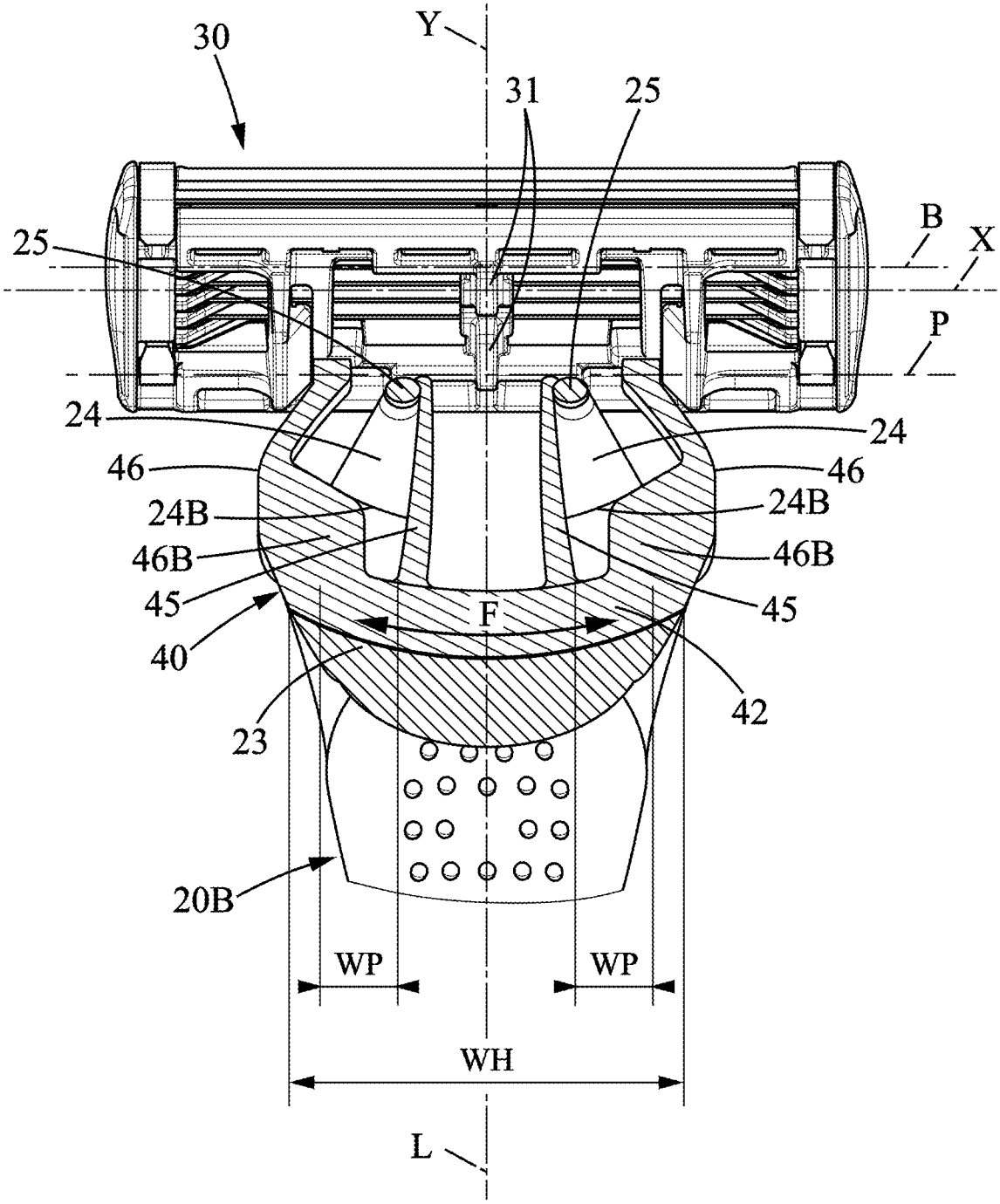
FIG. 5A shows a partial top view of the proximal part of the handle according to the second embodiment with the connector being in the neutral position.
Figure 5B:
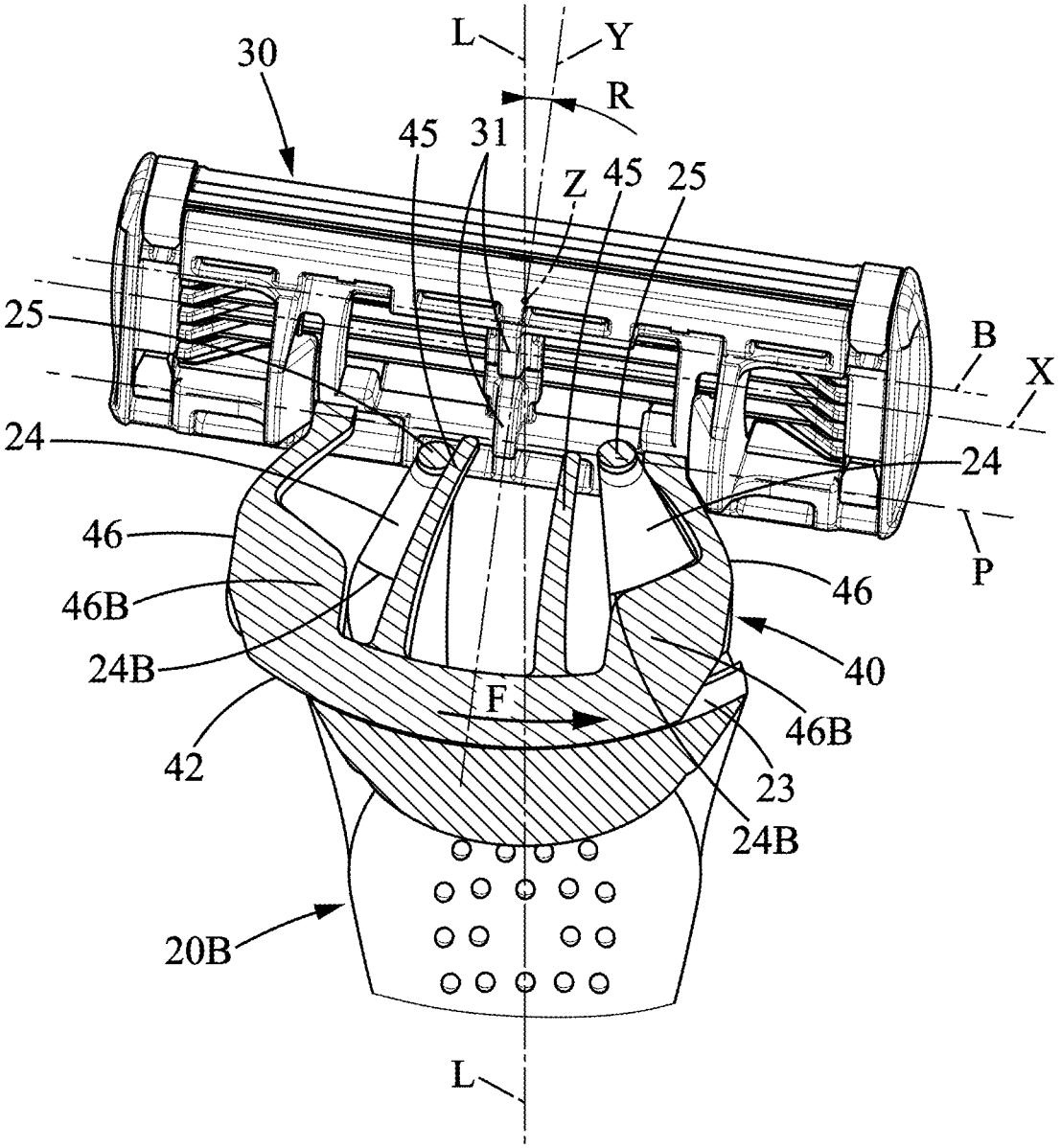
FIG. 5B shows a partial top view of the proximal part of the handle according to the second embodiment with the connector being in an end rotated position.

FIGS. 4A-4B detail the rotational movement of the connector 40 around the rocking axis Z, when the handle 20 is provided with an elongated support 22 extending from the middle of the width WH of the proximal end 20B of the handle 20.

The elongated support 22 comprises an upwardly protruding block 22B for fixing the connector 40 to the handle 20. In this case, the deflecting means are in the form of a deflector 22A forming an end of the elongated support 22, the end being curved in the upward direction. For clarity, the cartridge 30 is not shown in FIGS. 4A-4B. In the original position, when no shaving forces are applied to the cartridge 30, the mutual configuration of the individual elements with respect to each other is as illustrated in FIG. 4A. The left lateral tongue 45 of FIG. 4A abuts closely the deflector 22A from left. The right lateral tongue 45 of FIG. 4A abuts closely the deflector from right. It can be seen that once the connector 40 starts to swivel in one of the directions labelled with the arrow F, with respect to the handle 20, as the shaving forces emerge, one of the lateral tongues 45 is flexed (i.e. deflected from its original position) by the deflector 22A. The function of each lateral tongue 45 is to exert biasing force through the deflector 22A on the handle 20, in order to force the connector 40 back to its original non-rotated position as illustrated on FIG. 4A. The non-rotated position refers to such a position, when the connector 40 is not rotated around the rocking axis Z. Due to their mutual interconnection, in the non-rotated position neither the connector 40, nor the cartridge 30 are rotated about the rocking axis Z.

FIG. 4B shows the connector 40 rotated to the left side (i.e. the arcuate face 42 of the connector 40 slides to the left with respect to the oval depression 23 of the handle 20), which results in the right elastic tongue 45 being flexed to the right. In this situation, the right elastic tongue exerts a non-zero force back onto the deflector 22A, such that the connector 40 is rotated back to the right, as soon as the shaving forces vanish. The connector rotates in the direction of the arrow F as shown on FIG. 4B. When the connector 40 is rotated to the right, by way of the applied shaving forces, the left lateral tongue 45 is flexed and returns the connector 40 back into the non-rotated position, as soon as the shaving forces cease to exist. FIG. 4B shows the connector 40 in a partially rotated position (full line), in comparison to the non-rotated position (dashed line). FIG. 4B also shows the connector 40 in an end rotated position (dash-dotted line). In the end rotated position the connector 40 is rotated to such an angle that the stud 43 contacts one of the two hooks 21A. FIG. 4B shows the stud 43, which protrudes upwardly from the central part of the arcuate face 42 and prevents the connector 40 from being rotated further. The connector 40 is adapted to rock from a rest position to a first end position or a second end position. In the first end position the rocking of the connector 40 is stopped by the stud coming into contact with a first of the pair of hooks 21A. In the second end position the rocking of the connector 40 is stopped by the stud 43 coming into contact with a second of the pair of hooks 41A. Similarly, is the function of the stop portions 42, which are depicted in FIG. 2. The stop portion 41 may be located on the bottom of the arcuate face 42 of the connector 40. The stop portions 41 may dispose at opposite ends of the arcuate face 42. The stop portions 41 may protrude downwardly from the arcuate face 42. As the connector 40 rotates either to the left or to the right, one of the stop portions 41 contacts the elongated support 22 in the middle of the width WH of the proximal end 20B of the handle 20 and prevents the connector 40 from being rotated further. The stop portions 41 may not be used, when an elongated support is disposed at a different place than in the middle of the proximal end 20B. However, the use of the stud 43 is still possible even in those cases.

As illustrated in FIG. 4B, when the connector 40 is in the end rotated position and the stud 43 contacts one of the hooks 21A, the connector 40 can only be rotated in one direction. This direction is illustrated by the singe arrow F.

In the non-rotated position, the angle R between the connector axis Y and the longitudinal handle direction L is equal to zero (viewed from a top view). Depending on the embodiment, the angle R in an end rotated position could range from 10° to 45°. For example, values of the angle R corresponding to the end rotated position are of 20° or 30°.

FIG. 5A shows another embodiment where two platform supports 24 extend forwardly from each side of the proximal end 20B of the handle 20. The platform supports 24 each comprise an upwardly protruding step 24B extending along the entire width of the platform support 24 and adapted to fix the connector 40 to the handle 20 by engaging with a portion of each arm 46. The step 24B could be engaged with a corresponding reinforcing rib 46B. The deflecting means can be in the form of a pin 25 located at the end of each platform support 24. The pins 25 protrude in the upward direction. Further, FIG. 5A shows an initial position of the connector 40, the cartridge 30 and the lateral tongues 45. For clarity, the central tongue 44 is omitted from FIGS. 5A-5B. In the initial position, when no shaving forces are applied, the lateral tongues 45 are in a relaxed position (i.e. under no tension) and the connector 40 is in the non-rotated position. The left lateral tongue 45 abuts the pin 25 of the left platform support 24 from the right. The right lateral tongue 45 abuts the pin 25 of the right platform support 24 from the left.

In the non-rotated position of FIG. 5A, the connector 40 can be rotated in any of the directions illustrated by the double-arrow F.

FIG. 5B shows a situation, when due to the presence of the shaving forces the connector 40 is rotated towards the left side. This rotation causes the left lateral tongue 45 to flex, as it is forced to bend to the right by the corresponding pin 25 of the left platform support 24. Once the shaving forces disappear, the left elastic tongue 45, which is under the tension, exerts biasing force to the corresponding pin 25, thus rotating the connector 40 back into the non-rotated position. During the rotational motion of the connector 40, the reinforcing ribs 46B are engaged with the corresponding step 24B in the platform supports 24. As apparent from the FIG. 5B, when the connector 40 is fully rotated, one of the reinforcing ribs 46B may lose contact with, and therefore disengage from the corresponding step 24B. Firm attachment of the connector 40 to the handle 20 is then ensured by the other reinforcing rib 46B being fully engaged with the corresponding step 24B of the other platform support 24 of FIG. 5B. Attaching the connector 40 to the handle 20 only by means of reinforcing ribs 46B of the arms 46 and steps 24B on the platform supports is thus not suitable, when a single support is used in the middle of the proximal end 20B of the handle 20, since the rotation of the connector 40 with respect to the handle 20 would cause total disengagement of the connector 40 from the handle 20.

FIG. 5B shows the connector 40 in an end rotated position. This position occurs when one of the arms 46 meets with the corresponding portion of the platform support 24. Then the rotation of the connector 40 is stopped. The connector 40 then can be rotated only in one direction illustrated by the arrow F on FIG. 5B. When the connector 40 is in the end rotated position (with respect to the handle 20), the connector axis Y and the longitudinal handle direction L form an angle R. The angle R corresponds to the maximum rotation of the connector 40 with regard to the handle and can lie anywhere between 10-40°, for example the angle is 20°, or 30°.

In both embodiments of FIGS. 4A-4B and 5A-5B, lateral tongues 45 are adapted to exert return torque on the connector 40. More particularly, in the embodiment of FIGS. 4A-4B the return torque is exerted on the connector 40 via acting on the deflector 22A, and in the embodiment of FIGS. 5A-5B, the return toque is exerted on the connector 40 via acting on the corresponding pin 25. The return torque generated by each lateral tongue 25 lies between 0 and 30 Nmm, between 10 and 30 Nmm in some instances, and between 15 and 25 Nmm in others. The return toque exerted by lateral tongues 45 decreases, as the connector 40 is rotated to either side. The increase of the return toque may depend on the angle R either linearly or non-linearly. The increase of the return toque per degree may lie between 0.5 Nmm and 2 Nmm, between 0.67 Nmm and 2 Nmm in some instances, and between 1 and 1.67 Nmm in others.

In both embodiments of FIGS. 4A-4B and 5A-5B, the connector 40 comprises a central tongue 44 extending in a direction substantially perpendicular to both the pivot axis X and the rocking axis Z, such that the tip of the central tongue 44 contacts cam surfaces 31 on the backside of the cartridge 30. The central tongue 44 is adapted to flex as the cartridge 30 is pivoted about the pivot axis X, such that the central tongue 44 exerts a biasing force to the cartridge 30, when the cartridge 30 is pivoted around the pivot axis X, thus returning the cartridge 30 to a non-pivoted position. Alternative embodiments having only the rocking axis Z without the presence of the pivot axis X are also possible, since the two rotational movements are designed to be independent of each other.

Figure 7:
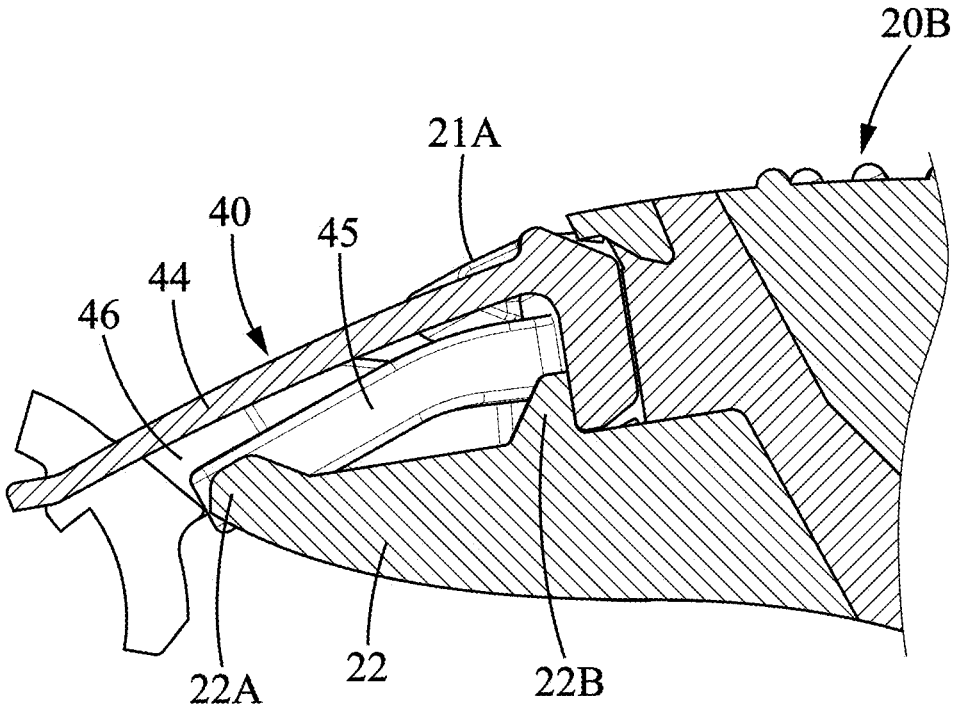
FIG. 7 is a cross section along line VII of FIG. 4A.
Figure 8:
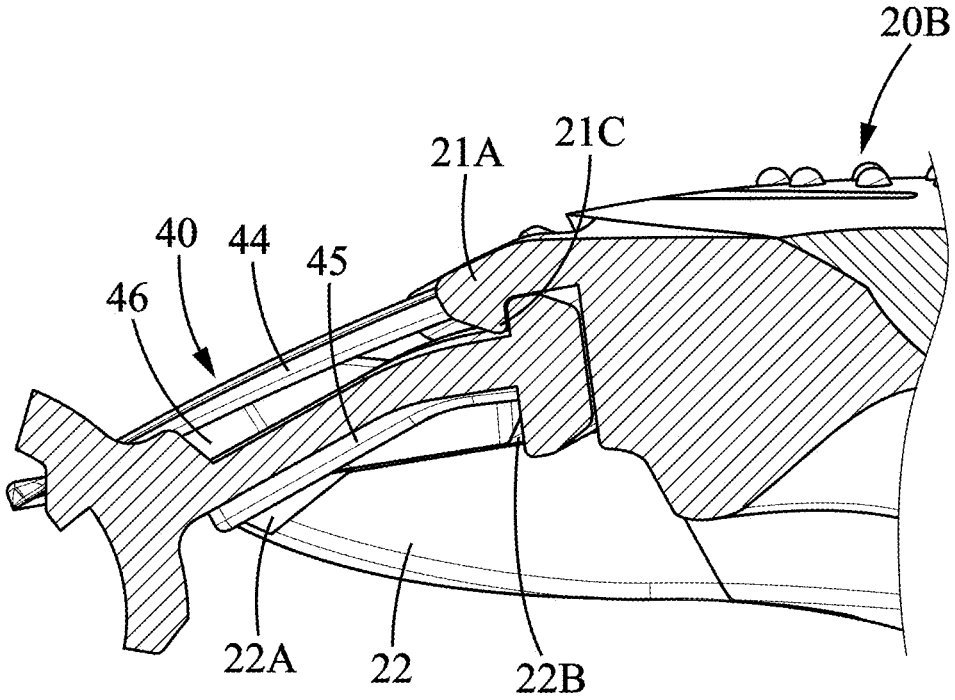
FIG. 8 is a cross section along line VIII of FIG. 4A.

FIGS. 7 and 8 show two cross-sections through the connector 40 and the proximal end 20B of the handle 20. FIG. 7 illustrates how the connector 40 is supported by the elongated support 22 from below, and how the connector 40 is locked in position by the block 22B. In contrast, FIG. 8 shows how the connector 40 is locked in position from above by a hook 21A. FIG. 8 shows an embodiment, in which the central tongue 44 is located above the plane PY formed by the arms 46.

The invention claimed is:

1. A shaving handle system for holding a cartridge, the shaving handle system comprising:

a handle and a connector;

wherein the handle has a distal end and a proximal end, and includes a deflector disposed at the proximal end, the handle extending longitudinally between the distal end and the proximal end to define a longitudinal axis;

wherein the connector includes two lateral tongues and is configured to be connected to the handle to rotate about an axis that is perpendicular to the longitudinal axis;

wherein the two lateral tongues abut the deflector so that when the connector is rotated in a first direction about the axis perpendicular to the longitudinal axis of the handle, one of the two lateral tongues is flexed by the deflector, and so that when the connector is rotated in a second direction about the axis perpendicular to the longitudinal axis of the handle, the other of the two lateral tongues is flexed by the deflector, wherein the connector includes a pair of elongated arms, each one of the pair of elongated arms having an end, the ends of the pair of elongated arms facilitating movable attachment of the connector along the axis perpendicular to the longitudinal axis of the handle.

2. The shaving handle system according to claim 1, wherein the handle includes an elongated support and a pair of hooks, and wherein the elongated support and the pair of hooks extend from the proximal end of the handle for movably attaching the connector to the handle.

3. The shaving handle system according to claim 2, wherein the handle has an upper face and a lower face, the upper face being opposite to the lower face, and wherein the elongated support extends from the lower face and the pair of hooks extend from the upper face.

4. The shaving handle system according to claim 2, wherein the elongated support includes an upwardly protruding block for fixing the connector to the handle, and wherein the deflector forms an end of the elongated support and is curved upwardly in a direction away from the longitudinal axis of the handle.

5. The shaving handle system according to claim 2, wherein the elongated support has a width, taken along the axis perpendicular to the longitudinal axis, that is not greater than one-third of a width of the proximal end of the handle, taken along the axis perpendicular to the longitudinal axis.

6. The shaving handle system according to claim 1, wherein the axis perpendicular to the longitudinal axis is a rocking axis, and the connector is movable between a first end position and a second end position along the rocking axis.

7. The shaving handle system according to claim 6, wherein the proximal end of the handle includes an oval depression, and the connector is provided with an arcuate face, the arcuate face corresponding to the shape of the oval depression, the arcuate face of the connector being adapted to rock along the oval depression and about the rocking axis.

8. The shaving handle system according to claim 7, further comprising a stud protruding upwardly from the connector, wherein the connector is adapted to rock from a rest position to the first end position or the second end position, and wherein in the first end position, the stud comes into contact with a first one of a pair of hooks and the connector is stopped from rocking, and in the second end position, the stud comes into contact with a second one of the pair of hooks and the connector is stopped from rocking.

9. The shaving handle system according to claim 1, wherein each one of the pair of elongated arms includes a bearing structure.

10. The shaving handle system according to claim 1, wherein the pair of elongated arms extend substantially in a common plane, and wherein the connector includes a flexible central tongue extending substantially in the same plane as the pair of elongated arms.

11. The shaving handle system according to claim 10, wherein the flexible central tongue and each of the two lateral tongues are separated and independent of each other.

12. The shaving handle system according to claim 1, further comprising two elongated supports extending forwardly from opposing sides of the proximal end of the handle, each of the two elongated supports including an upwardly protruding step extending along an entire width of the elongated support and being adapted to fix the connector to the handle, and wherein the deflector is a pin located at a free end of the elongated support and protrudes upwardly from the elongated support.

13. The shaving handle system according to claim 12, wherein the connector further includes reinforcing ribs extending along a length of each one of the pair of elongated arms and towards a center of the connector, and wherein the reinforcing ribs being adapted to engage, respectively, with the step of each one of the elongated supports, thereby fixing the connector to the handle.

14. A shaving razor comprising a cartidge and a shaving handle system, the shaving handle system comprising a handle and a connector, the handle having a distal end and a proximal end, and including a deflector disposed at the proximal end, the handle extending longitudinally between the distal end and the proximal end to define a longitudinal axis, wherein the connector includes two lateral tongues and is configured to be connected to the handle to rotate about an axis that is perpendicular to the longitudinal axis, wherein the two lateral tongues abut the deflector so that when the connector is rotated in a first direction about the axis perpendicular to the longitudinal axis of the handle, one of the two lateral tongues is flexed by the deflector, and so that when the connector is rotated in a second direction about the axis perpendicular to the longitudinal axis of the handle, the other of the two lateral tongues is flexed by the deflector, wherein the cartridge includes at least one blade having a blade edge extending along a blade edge axis, and wherein the handle includes an elongated support and a pair of hooks, and wherein the elongated support and the pair of hooks extend from the proximal end of the handle for movably attaching the connector to the handle.

15. The shaving razor according to claim 14, wherein the axis perpendicular to the longitudinal axis of the handle is a rocking axis, wherein the cartridge includes a pivot axis which intersects the rocking axis, wherein the connector includes a pair of elongated arms, each of the pair of arms having an end and wherein the connector is movably attached perpendicularly to the rocking axis and the pivot axis.

16. The shaving razor according to claim 15, wherein the blade edge axis is parallel to the pivot axis.

17. The shaving razor according to claim 15, wherein the cartridge and the connector are attached to each other so that the cartridge and the connector rotate simultaneously about the rocking axis.

18. The shaving razor according to claim 15, wherein the cartridge is pivotally attached to the connector along the pivot axis.

19. A shaving razor comprising a shaving handle system and a cartridge, the shaving handle system comprising:

a handle and a connector;

wherein the handle has a distal end and a proximal end, and includes a deflector disposed at the proximal end, the handle extending longitudinally between the distal end and the proximal end to define a longitudinal axis;

wherein the connector includes two lateral tongues and is configured to be connected to the handle to rotate about an axis that is perpendicular to the longitudinal axis wherein the two lateral tongues abut the deflector so that when the connector is rotated in a first direction about the axis perpendicular to the longitudinal axis of the handle, one of the two lateral tongues is flexed by the deflector, and so that when the connector is rotated in a second direction about the axis perpendicular to the longitudinal axis of the handle, the other of the two lateral tongues is flexed by the deflector, wherein the cartridge includes at least one blade having a blade edge extending along a blade edge axis, wherein the cartridge includes a pivot axis, wherein the axis perpendicular to the longitudinal axis of the handle is a rocking axis, and wherein the pivot axis and the rocking axis intersect each other.

* * * * *